US005269172A

United States Patent [19]

Daigle et al.

[11] Patent Number: 5,269,172

[45] Date of Patent: Dec. 14, 1993

[54] PROCESSES AND APPARATUS FOR THE PREVENTION, DETECTION AND/OR REPAIR OF LEAKS OR AVENUES FOR LEAKS FROM ABOVE-GROUND STORAGE TANKS

[75] Inventors: Emanuel L. Daigle, Gonzales; John C. Watson, Brusly, both of La.

[73] Assignee: The Dow Chemical Company, Midland, Mich.

[21] Appl. No.: 808,142

[22] Filed: Dec. 16, 1991

[51] Int. Cl.[5] ..... G01M 3/20

[52] U.S. Cl. ..... 73/40.7; 73/49.2

[58] Field of Search ..... 73/49.2, 40.7; 220/627, 220/626

[56] References Cited

U.S. PATENT DOCUMENTS

| | | | |
|---|---|---|---|
| 2,220,186 | 11/1940 | Walker | 220/627 |
| 3,902,356 | 9/1975 | Rupf-Bolz | 73/49.2 |
| 4,918,978 | 4/1990 | Green | 73/49.2 |
| 4,939,833 | 7/1990 | Thomas | 73/49.2 X |
| 5,048,324 | 9/1991 | Thompson | 73/49.2 X |

FOREIGN PATENT DOCUMENTS

| | | | |
|---|---|---|---|
| 2534832 | 2/1976 | Fed. Rep. of Germany | 73/49.2 |
| 240358 | 10/1986 | German Democratic Rep. | 73/49.2 |
| 222741 | 11/1985 | Japan | 73/49.2 |
| 269032 | 11/1987 | Japan | 73/49.2 |
| 223839 | 9/1990 | Japan | 73/49.2 |

*Primary Examiner*—Hezron E. Williams
*Assistant Examiner*—Joseph W. Roskos

[57] ABSTRACT

A storage tank apparatus is described which comprises an above-ground storage tank having a first, lowermost bottom, a second bottom joined to the walls of the storage tank above the first, lowermost bottom and defining a space between the first and second bottoms, structural support means placed in the space between the first and second bottoms for supporting the second bottom above the first bottom, and a plurality of sampling ports spaced about the perimeter of the storage tank and permitting access to the space between the first and second bottoms and to the avenues for fluid communication provided therethrough by the structural support means. Processes for detecting leaks and avenues for leaks of materials placed in the storage tanks of such apparatus are also described.

4 Claims, 3 Drawing Sheets

PROCESSES AND APPARATUS FOR THE PREVENTION, DETECTION AND/OR REPAIR OF LEAKS OR AVENUES FOR LEAKS FROM ABOVE-GROUND STORAGE TANKS

BACKGROUND OF THE INVENTION

The present invention relates to above-ground storage tanks and to the prevention, detection and/or repair of leaks or avenues for leaks from the bottoms of such tanks.

One approach to preventing leaks taken in the construction of new above-ground storage tanks involves placing a plastic liner inside a supporting ring wall-type concrete foundation and underneath the tank bottom (with the tank bottom forming, of course, the primary barrier to leaks of the tank contents to groundwater and the tank's immediate environment). On many existing storage tanks, however, the tank bottom is effectively the only barrier between the tank's contents and the environment.

As to these existing above-ground tanks, there are a limited number of options available for repairing leaks which develop in the tank, or in the absence of a known leak for adding a second barrier between a tank's contents and the environment to prevent leaks to the environment. One option is to replace and reconstruct the tank entirely. A second option is to lift the tank according to U.S. Pat. Nos. 4,807,851 and 4,930,750 and place a plastic liner inside the foundation and under the tank's bottom as if it were a new construction. A third option, and the option most frequently elected because of the expense, time and difficulty associated with the other two options, is to install a second bottom above the original bottom.

Generally this second bottom is welded to the walls of the tank above the original bottom, and on top of a bed of sand or other granular supporting material. For the tank's contents to reach the environment, the materials in question must leak through the second bottom or through the welds between the second bottom and the tank wall, through the sand bed, and through the original bottom.

In trying to prevent or minimize leaks to the environment, and since the sand bed defines paths for movement of the tank's contents therethrough, the sand bed of a given retrofitted tank conventionally is monitored for the presence therein of the tank's contents via nozzles or ports placed in the side of the tank and in fluid communication with the sand bed. When a leak through the second bottom does occur, however, the sand bed must be regenerated by removing and replacing the contaminated sand. This is a labor intensive, costly exercise, and in addition generates a great deal of contaminated sand for incineration or landfilling.

SUMMARY OF THE INVENTION

The present invention solves these problems and others not satisfactorily addressed by the known art in providing a new and improved storage tank apparatus. This storage tank apparatus of the present invention broadly comprises an above-ground storage tank having a first, lowermost bottom, a second bottom joined to the walls of the storage tank above the first, lowermost bottom and defining a space between the first and second bottoms, structural support means placed in the space between the first and second bottoms for supporting the second bottom above the first bottom, which means defines avenues for fluid communication through the space between the first and second bottoms, and a plurality of sampling ports spaced about the perimeter of the storage tank, and permitting access to the space between the first and second bottoms and to the avenues for fluid communication provided therethrough. In a particular embodiment, an instrumentation flange is also present which permits monitoring instruments direct access to the space between the first and second bottoms and to the avenues for fluid communication provided therethrough.

In another, related aspect, a process is provided for detecting leaks through the second bottom and into the space between the first and second bottoms of a material placed in a storage tank of a storage tank apparatus of the type described in the preceding paragraph, said process comprising the steps of collecting a fluid sample from the space and from the avenues for fluid communication provided therein and thereafter analyzing the samples thus collected for the particular material placed in the storage tank.

In still another aspect, the present invention provides a process for detecting avenues for leaks through the second bottom and into the space between the first and second bottoms of a material placed in the storage tank of a storage tank apparatus as described above, wherein the process comprises the steps of injecting an inert gas into the space through one or more of the storage tank's sampling ports at low pressures while keeping the remaining sampling ports closed to the surrounding atmosphere, monitoring at these remaining sampling ports for the inert gas, sealing or closing off all of the plurality of sampling ports when the inert gas is detected at each of the remaining sampling ports, and monitoring the interior of the storage tank for leaks of the inert gas from the space between the first and second bottoms through the second or upper bottom or through the connection of the second bottom to the walls of the storage tank.

DETAILED DESCRIPTION OF THE ILLUSTRATED EMBODIMENT

Figure 1:
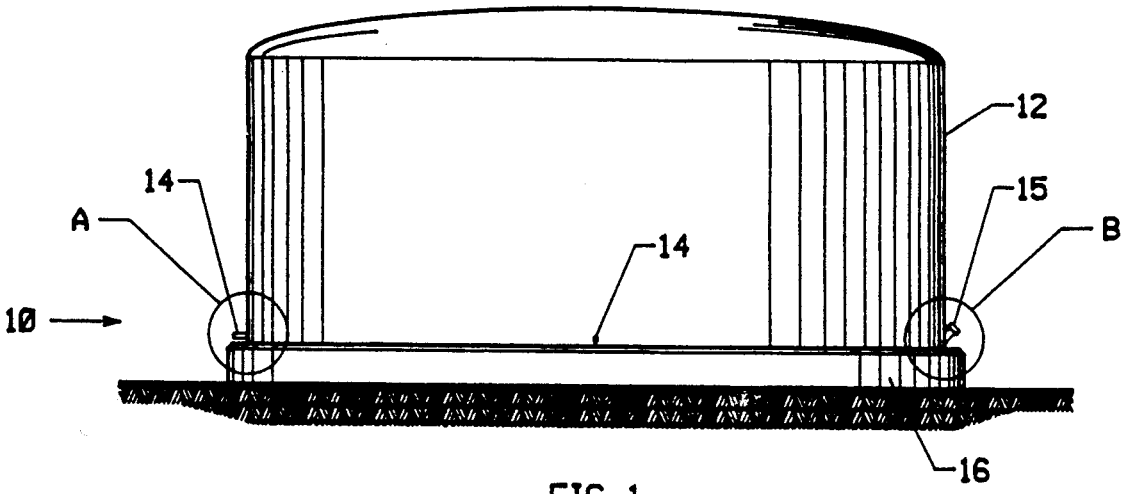
FIG. 1 is a side view of a storage tank apparatus of the present invention.
Figure 3:
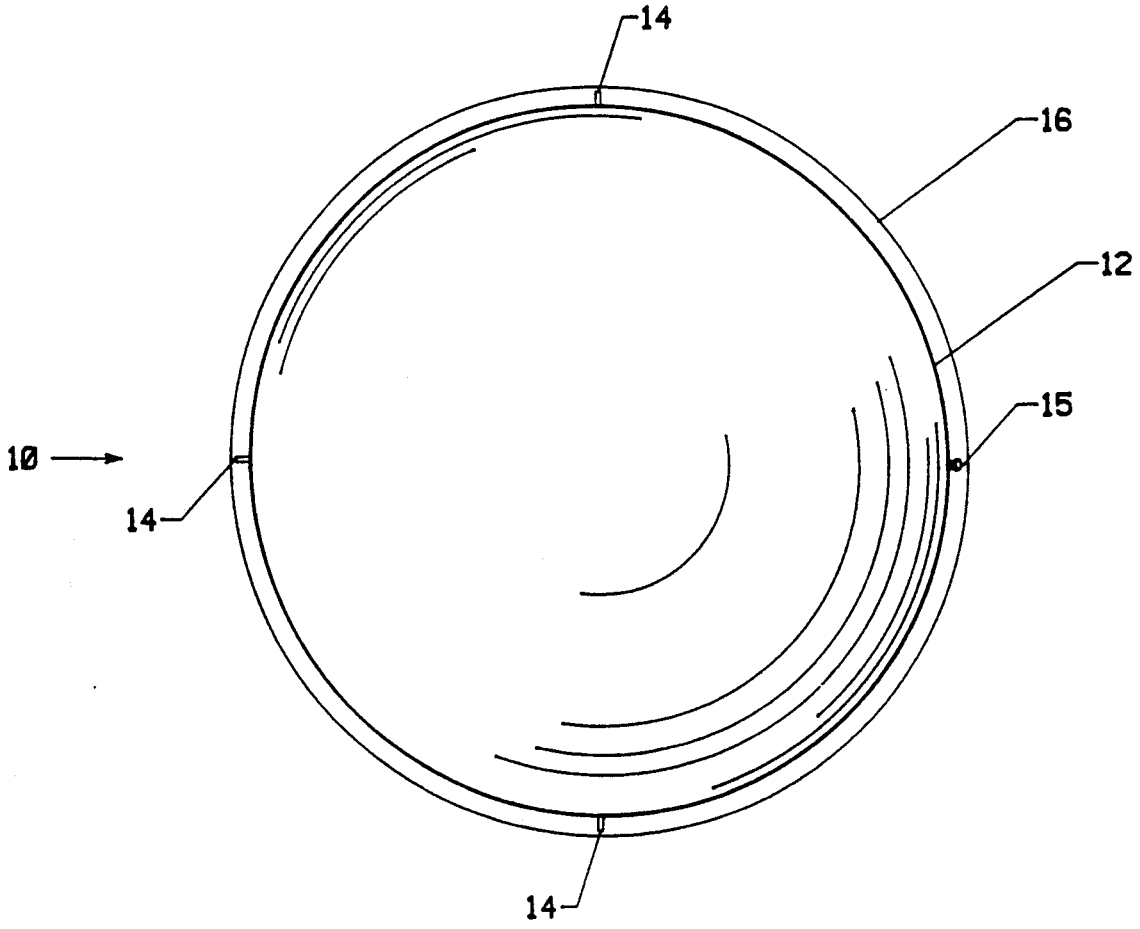
FIG. 3 is a top view of the storage tank apparatus of FIG. 1.

Referring now to the drawings, and more particularly to FIG. 1, a storage tank apparatus 10 of the present invention is illustrated which comprises an above-ground storage tank 12, a plurality of sampling ports 14 which are spaced around the perimeter of the tank 12 (see FIG. 3) and which are preferably evenly distributed around the perimeter of the tank 12, and an instrumentation flange 15.

Figure 2:
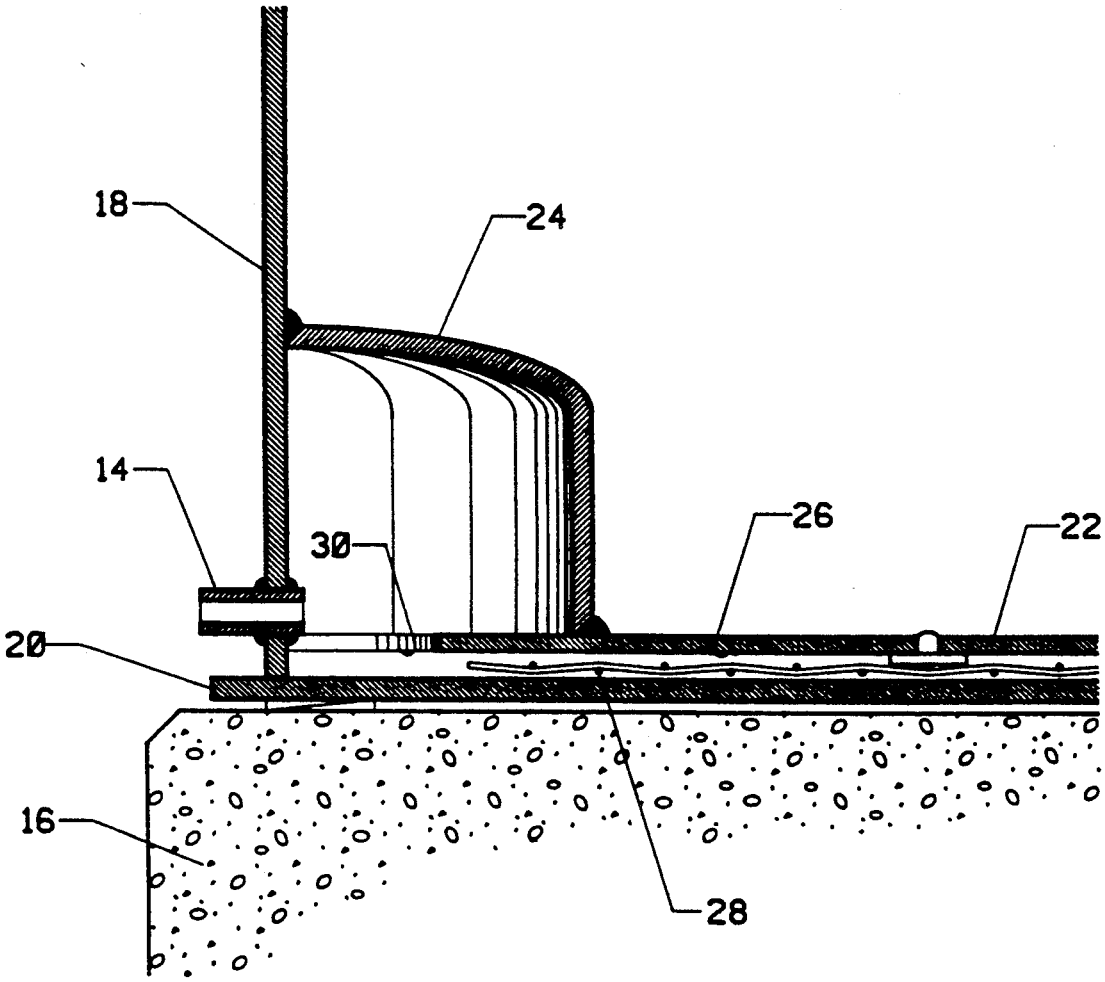
FIG. 2 is a cross-sectional view of a portion of the storage tank apparatus of FIG. 1, taken in the enclosed area designated by "A" in FIG. 1.

Referring now to FIG. 2, the tank 12 is supported on a concrete ring wall-type foundation 16 which extends above ground level. The tank 12 in the area of a sampling port 14 (such area corresponding to the enclosed area designated by "A" in FIG. 1) is comprised of a wall portion 18, a first or original bottom 20 welded to the wall portion 18, and a second bottom 22 spaced above the first bottom 20 and welded to the wall portion 18 directly or indirectly through a cap 24.

To support the second bottom 22 above the first bottom 20 when the tank 12 is filled, and so that a space 26 including avenues for fluid flow therein is defined between the first and second bottoms 20 and 22, structural support means (not forming an integral part of either the first or second bottoms 20 or 22) is provided in the form of an area of woven wire mesh 28.

This area of woven wire mesh 28 preferably supports and underlies substantially all of the second bottom 22 so that the structural support means for the tank 12 can be installed easily and quickly, although a number of discrete, structural support elements or members of various types and configurations could conceivably be employed. The idea behind employing the area of woven wire mesh 28 is to provide the support to the second bottom 22 that is required, while being easy to install and remove and while further being amenable to being cleaned and/or dried out in place. These properties may be contrasted with the difficulties presented by the sand- or other granular material-filled spaces in previous storage tank apparatus. Accordingly, fewer elements providing greater free area for fluid flow across a cross-section of the space 26, and especially a free area of about 40 percent or greater, are generally to be preferred over a larger number of such elements providing the same or a lesser free area for fluid flow through space 26.

A sampling port 14 extends through the wall portion 18, and is placed in fluid communication with the space 26 and the avenues for fluid communication defined therein via an opening 30 in the second bottom 22 under cap 24. The cap 24 isolates the contents of the tank 12 from the sampling port 14 and the space 26, and is welded to the first bottom 20 and the wall portion 18. The cap 24 may be constructed, for example, from a standard pipe cap which has been cut to match the curvature of the tank 12 (see FIG. 3).

Figure 4:
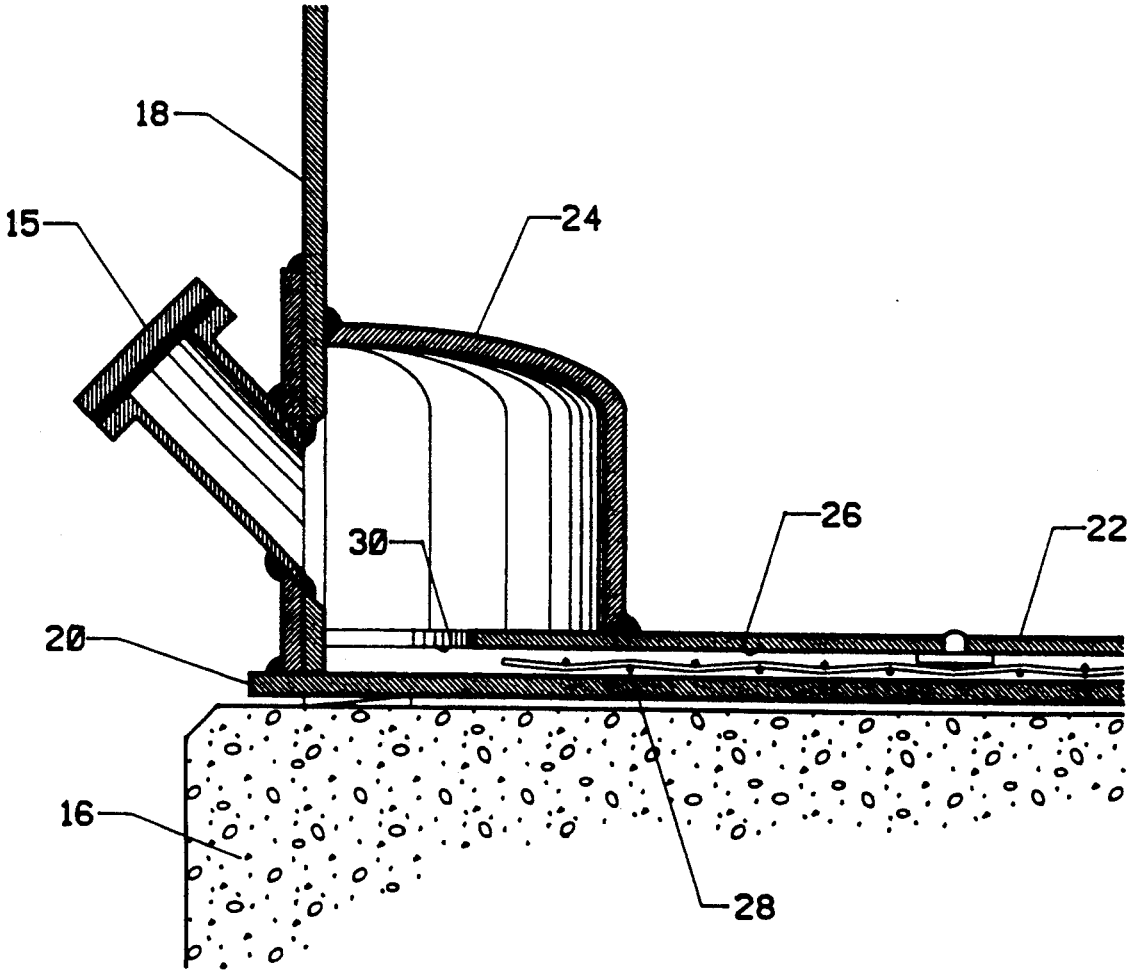
FIG. 4 is a cross-sectional view of a portion of the storage tank apparatus of FIG. 1, taken in the enclosed area designated by "B" in FIG. 1.

The primary reason for the rather involved construction of FIG. 2 can be seen in FIG. 4, wherein the sampling port 14 has been replaced with the instrumentation flange 15. Instrumentation flange 15 provides direct access of monitoring instrumentation (not shown) to the space 26 and the avenues for fluid communication defined therein, and could be used to simplify the collecting and analyzing of fluid samples from the space 26 on a continual or routine basis.

Where an instrumentation flange 15 is not desired or needed, the cap 24 and opening 30 are preferably omitted in FIG. 2 and the sampling port 14 is placed in direct fluid communication with the space 26 between the first and second bottoms 20 and 22. This could involve simply adding an elbow, for example, to the sampling port 14 and making a welded connection between the elbow and the second bottom 22.

The depicted storage tank apparatus 10 is useful for effecting a repair of a leak or closing off the avenue of a possible leak in the first, original bottom 20, in that a second bottom 22 is interposed as the new bottom of the storage tank 12. The apparatus 10 may also be used where the original bottom of a tank 12 has not leaked or does not appear to have established an avenue for the formation of leaks; in this application the second bottom 22 forms an additional, internal barrier between the storage tank's contents and the tank 12's environment. In this last regard it should be noted that the apparatus 10 of the present invention could further be employed even where a second, external barrier is already in place, i.e., where a plastic liner has been placed underneath the tank 12 and inside a concrete ring wall-type foundation.

The provision in the apparatus 10 of sampling ports 14, of instrumentation flange 15, and especially of structural support means such as the woven wire mesh 28 allows for several useful processes to be performed on and with the apparatus 10. One process, already mentioned in passing above, would involve cleaning or drying out the space 26 after a leak of materials from the tank 12 through the second bottom 22 or perhaps more likely, through the welded connections between the second bottom 22 and a wall portion 18 or cap 24, by circulating a purging fluid through the space 26. Whereas previously a bed of contaminated sand would need to be removed to effectively permit an inert carrier gas, for example, to be injected through a sampling port 14 and to circulate through the space 26 and pick up new leaks of materials from the tank 12, the present invention permits the space 26 and structural support elements therein to be sufficiently cleaned in place so as to not require the tank 12 to be emptied, disassembled and cleaned and further so as to not require the use of landfill space or incineration.

The apparatus 10 is also well adapted for identifying avenues for leaks through the second bottom 22 and into the space 26 between the first and second bottoms 20 and 22. A preferred process is performed when the tank 12 is empty and includes injecting an inert gas such as helium into the space 26 through one or more of the sampling ports 14 at low pressures, e.g, about 0.5 psig, while keeping the remaining sampling ports 14 closed to the surrounding atmosphere.

Enough helium is added to the space 26 so that after a reasonable period of time, helium may be detected at super-ambient levels at each of the various sampling ports 14 scattered around the perimeter of the tank 12. Preferably, however, the amount of helium added is not so great that in the event of a leak, the oxygen content in the tank 12 is reduced to a point where breathing apparatus would be required to enter and test the tank 12 safely. To ensure that this threshold is not crossed, it will be necessary to calculate the amount of helium necessary to reduce the oxygen levels to this point, assuming all of the helium leaked from the space 26 into the tank 12. The amount of helium used is then preferably kept below this calculated amount.

When helium has been detected at each of the sampling ports 14 in super-ambient levels, then these ports 14 are sealed and the tank 12 is entered. A device, preferably a portable device, is then used to detect the presence of helium in the tank and particularly at the welds between the second bottom 22 and a wall portion 18 and/or cap 24. Suitable detecting devices include, for example, a Model 21-250 thermal conductivity leak detector from Gow Mae Instrument Company, Bound Brook, N. J., or more preferably a Portatest II* brand portable helium leak detector from Varian Associates, Inc., Palo Alto, Cal. is used. The latter device is preferred because it detects only helium and is more sensitive than the Gow Mac detector. When an avenue for leaks of stored materials is detected, as for example at a weld, then the location is marked for repair and repaired prior to filling the storage tank 12.

It should be recognized that while the above-described leak detection process is considered as being particularly adapted to the storage tank apparatus of the present invention, the same process may have utility in testing tanks having sand- or granular material-filled spaces between first and second bottoms, since in these more conventional apparatus the sand or other granular material also permits helium to be conveyed therethrough from one sampling port 14 to another sampling port 14. The remainder of the process is conducted as before.

Finally, the process could also have utility in determining the integrity of the bottoms in those storage tanks which have but a single, original bottom. In this embodiment of the process, sampling ports are opened up in the concrete ring wall-type or other (e.g., earthen) foundation supporting a tank at least at its perimeter and are made to extend into a void space between the bottom of the tank and either a plastic liner, the ground or an accumulation of a settleable material (e.g., dirt or sand) inside the tank's perimeter and which underlies and in the case of the settleable material, at least partially supports the tank when filled. This void space in the last instance is created when a filled tank presses down upon and compacts the settleable material and then withdraws to leave a void space as the tank is emptied.

An inert gas such as helium is again injected through one or more of these sampling ports, the remaining sampling ports are sealed to the surrounding environment, and the interior of the tank 12 is monitored for helium rising through avenues for leaks in the tank's bottom.

While preferred embodiments of the apparatus and processes of the present invention have been described, it will be recognized in view of the foregoing that a number of changes may be made to these embodiments without departing in scope or spirit from the present invention as defined in the claims below.

What is claimed is:

1. A process, in relation to a storage tank apparatus which comprises an above-ground storage tank having a first, lowermost bottom, a second bottom joined to the walls of the storage tank above the first, lowermost bottom and defining a space between the first and second bottoms, structural support means placed in the space between the first and second bottoms for supporting the second bottom above the first bottom, which means defines avenues for fluid communication through the space between the first and second bottoms, and a plurality of sampling ports spaced about the perimeter of the storage tank and permitting access to the space between the first and second bottoms and to the avenues for fluid communication provided therethrough, for detecting avenues for leaks of a material placed in the storage tank through the second bottom and into the space between the first and second bottoms, comprising the steps of:

injecting an inert gas into the space through one or more of the sampling ports at low pressures while keeping the remaining sampling ports closed to the surrounding atmosphere;

monitoring at these remaining sampling ports for the inert gas;

sealing or closing off all of the plurality of sampling ports when the inert gas is detected at each of the remaining sampling ports where injection of the inert gas did not occur; and monitoring the interior of the storage tank for leaks of the inert gas from the space between the first and second bottoms through the second or upper bottom or through the connection of the second bottom to the walls of the storage tank.

2. A process as defined in claim 1, wherein the inert gas is helium.

3. A process, in relation to a storage tank apparatus which comprises an above-ground storage tank having a first, lowermost bottom, a second bottom joined to the walls of the storage tank above the first, lowermost bottom and defining a space between the first and second bottoms, means placed in the space between the first and second bottoms for supporting the second bottom above the first bottom, which means defines avenues for fluid communication through the space between the first and second bottoms, and a plurality of sampling ports spaced about the perimeter of the storage tank and permitting access to the space between the first and second bottoms and to the avenues for fluid communication provided therethrough, for detecting avenues for leaks of a material placed in the storage tank through the second bottom and into the space between the first and second bottoms, comprising the steps of:

injecting an inert gas into the space through one or more of the sampling ports at low pressures while keeping the remaining sampling ports closed to the surrounding atmosphere;

monitoring at these remaining sampling ports for the inert gas;

sealing or closing off all of the plurality of sampling ports when the inert gas is detected at each of the remaining sampling ports where injection of the inert gas did not occur; and monitoring the interior of the storage tank for leaks of the inert gas from the space between the first and second bottoms through the second or upper bottom or through the connection of the second bottom to the walls of the storage tank.

4. A process as defined in claim 3, wherein the inert gas is helium.

* * * * *